US007516531B2

(12) United States Patent
Crompton et al.

(10) Patent No.: US 7,516,531 B2
(45) Date of Patent: Apr. 14, 2009

(54) METHOD OF ASSEMBLING UNIVERSAL TRIM PIECE SYSTEM FOR A REFRIGERATOR

(75) Inventors: Edward Crompton, Iowa City, NE (US); Mark Jeffery Reimer, Coralville, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 69 days.

(21) Appl. No.: 11/521,492

(22) Filed: Sep. 15, 2006

(65) Prior Publication Data

US 2008/0120912 A1 May 29, 2008

(51) Int. Cl.
*B21D 39/03* (2006.01)
*B21K 21/16* (2006.01)

(52) U.S. Cl. ..... 29/428; 29/401.1

(58) Field of Classification Search ..... 29/428, 29/426.1, 401.1; 49/372, 462
See application file for complete search history.

(56) References Cited

U.S. PATENT DOCUMENTS

| | | | |
|---|---|---|---|
| 3,520,581 | A | 7/1970 | Borghi |
| 3,995,922 | A | 12/1976 | Ohashi |
| 4,229,921 | A | 10/1980 | Schell |
| 4,599,254 | A | 7/1986 | Cuttica |
| 5,358,326 | A | 10/1994 | Cherry et al. |
| 5,564,808 | A | 10/1996 | Gipson, Jr. et al. |
| 6,053,585 | A | 4/2000 | Osen |
| 6,536,856 | B2 | 3/2003 | Pelizzari et al. |
| 6,672,693 | B2 | 1/2004 | Kawakami |
| 2003/0222547 | A1 | 12/2003 | Trees |
| 2004/0178707 | A1 | 9/2004 | Avendano et al. |
| 2004/0222725 | A1 | 11/2004 | Park et al. |
| 2005/0006997 | A1 | 1/2005 | Yoshioka |

FOREIGN PATENT DOCUMENTS

| | | |
|---|---|---|
| JP | 07-055328 | 3/1995 |
| JP | 08-210767 | 8/1996 |

*Primary Examiner*—John C Hong
(74) *Attorney, Agent, or Firm*—Kirk Goodwin; Michael D. Lafrenz

(57) ABSTRACT

A universal trim piece system for a refrigerator door having a decorative panel can be employed with either a front mounted door handle or a side mounted door handle. When employing the front mounted handle, the door is provided with a top trim piece, a bottom trim piece and first and second side trim pieces. When employing the side mounted handle, the door is provided with the top trim piece, the bottom trim piece and only the first side trim piece, with the side mounted handle replacing the second side trim piece. Interchanging the handles/decorative panels just requires loosening the top and bottom trim pieces, exchanging the handles and possibly the decorative panels, providing a second side trim piece or handle, and re-secure the top and bottom trim pieces.

11 Claims, 4 Drawing Sheets

METHOD OF ASSEMBLING UNIVERSAL TRIM PIECE SYSTEM FOR A REFRIGERATOR

BACKGROUND OF THE INVENTION

1. Field of the Invention

The present invention pertains to the art of refrigerators and, more particularly, to a trim piece system that can be incorporated into a refrigerator employing door handles mounted to either a front face portion of a refrigerator door or side edge portions of the refrigerator door.

2. Discussion of the Prior Art

Refrigerators of various models and sizes are well known in the art. Typical refrigerator models include top mount, bottom mount and side-by-side versions. In addition, many refrigerators are available in a variety of standard or custom colors to match a consumers particular kitchen décor. However, in today's market, it is becoming more popular to recess refrigerators between adjacent cabinetry or the like in a kitchen area in order to provide a built-in look which is considered by many to be aesthetically appealing. Often times, the refrigerator will include wood or wood-like decorative panels that help the appliance to further blend with adjacent cabinetry. Since front doors of a refrigerator must be spaced from any adjacent structure in order to enable unobstructed movement, the refrigerator must project outward from the adjacent structure to some degree. Unfortunately, the outward projection of the refrigerator cabinet in this manner exposes, to a certain degree, frontal portions of the side walls of the cabinet and/or outer peripheral edges of the door(s). The exposed side walls and/or outer peripheral edge is considered to detract from the built-in appearance.

In order to minimize the appearance of the exposed portions of the cabinet and/or doors, it has been proposed to provide cosmetic trim pieces along exposed side portions of the cabinet and/or doors thereby establishing a more finished appearance, as well as serving as structure that retains the decorative panels on the doors. In addition to trim pieces, handles must also be fastened to the doors to allow a consumer to readily gain access to refrigerated compartments. The handles are typically secured to front face portions of the outer, decorative panels or along side edge portions of the door depending upon the particular model refrigerator. That is, refrigerators that employ outer, decorative wood panels are typically provided with door pulls that match the adjacent cabinetry, while other models may include a door handle that extends along an edge portion of the door. Of course, models that employ decorative wood panels can also include a door handle that extends along an outer edge portion of the door.

Unfortunately, the two different style handles require different door structure. More specifically, depending upon the door handle employed, the refrigerator door will require upper and lower trim pieces tailored for use with the specific handle. Doors that include decorative wood panels or the like require trim pieces that extend substantially an entire length of the upper and lower edge portions of the door. In contrast, doors that include handles that extend along side edge portions of the door require a shorter trim piece on the upper and lower edge portions of the door. The shorter trim pieces are required to accommodate caps or covers that hide exposed end portions of the side-mounted handle.

The two, unique trim pieces present a problem for manufacturers or, more accurately, consumers. A consumer who chooses one or the other style door cannot readily change that decision once the refrigerator is constructed. That is, given that wiring, plumbing and the like typically pass through upper and/or lower portions of the door, particularly at hinge points, exchanging longer and shorter trim pieces cannot be readily accomplished in the field. Thus, unless the consumer can afford the expense associated with essentially rebuilding or purchasing a completely new refrigerator door, once the refrigerator arrives in the home, it can no longer be readily modified to suit the consumers existing or future requirements.

Based on the above, there exists a need for a universal trim piece arrangement for refrigerator doors. More specifically, there exists a need for a universal trim piece system that can be mounted to upper and lower edge portions of a refrigerator door and employed in connection with doors having either front mounted handles or handles mounted along side edge portions of the door. Most importantly, the universal trim piece system can be readily employed with either door configuration without with requiring significant changes to the door itself, such as if a change in handles is desired.

SUMMARY OF THE INVENTION

The present invention is directed to a universal trim piece system for a refrigerator door having top, bottom and opposing side edges that collectively define an inner surface and an outer surface. An inner liner is secured to the inner surface of the door panel and an outer, decorative panel is secured to the outer surface. In accordance with the invention, the door is available with one of at least two distinct door handle configurations. The first constitutes a front mounted handle that is secured to the outer decorative panel and the second constitutes a side mounted handle that is mounted to, and extends substantially an entire length of, one of the opposing side edges of the door panel.

When employing the front mounted handle, the door is provided with a top trim piece, a bottom trim piece and first and second side trim pieces. The trim pieces are secured to the top, bottom and opposing side edges respectively. When employing the side mounted handle, the door is provided with the top trim piece, the bottom trim piece and only one of the first and second side trim pieces. Likewise, the trim pieces are secured to respective ones of the top, bottom and one of the opposing side edges. With this arrangement, the door handle itself constitutes the other of the first and second side trim pieces. If a handle change is desired, a customer or service person need simply loosen the top and bottom trim pieces, remove the side trim piece, exchange the handles and then re-secure the top and bottom trim pieces to the door. When switching from a side mounted handle to a front mounted handle, a new side trim piece and often times a new decorative panel are required. When switching from a front mounted handle to a side mounted handle, the side trim piece is exchanged for the side mounted handle and the decorative panel is also replaced. In this manner, the door does not require any significant disassembly to change door handles and can actually be accomplished by someone with only moderate skills.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
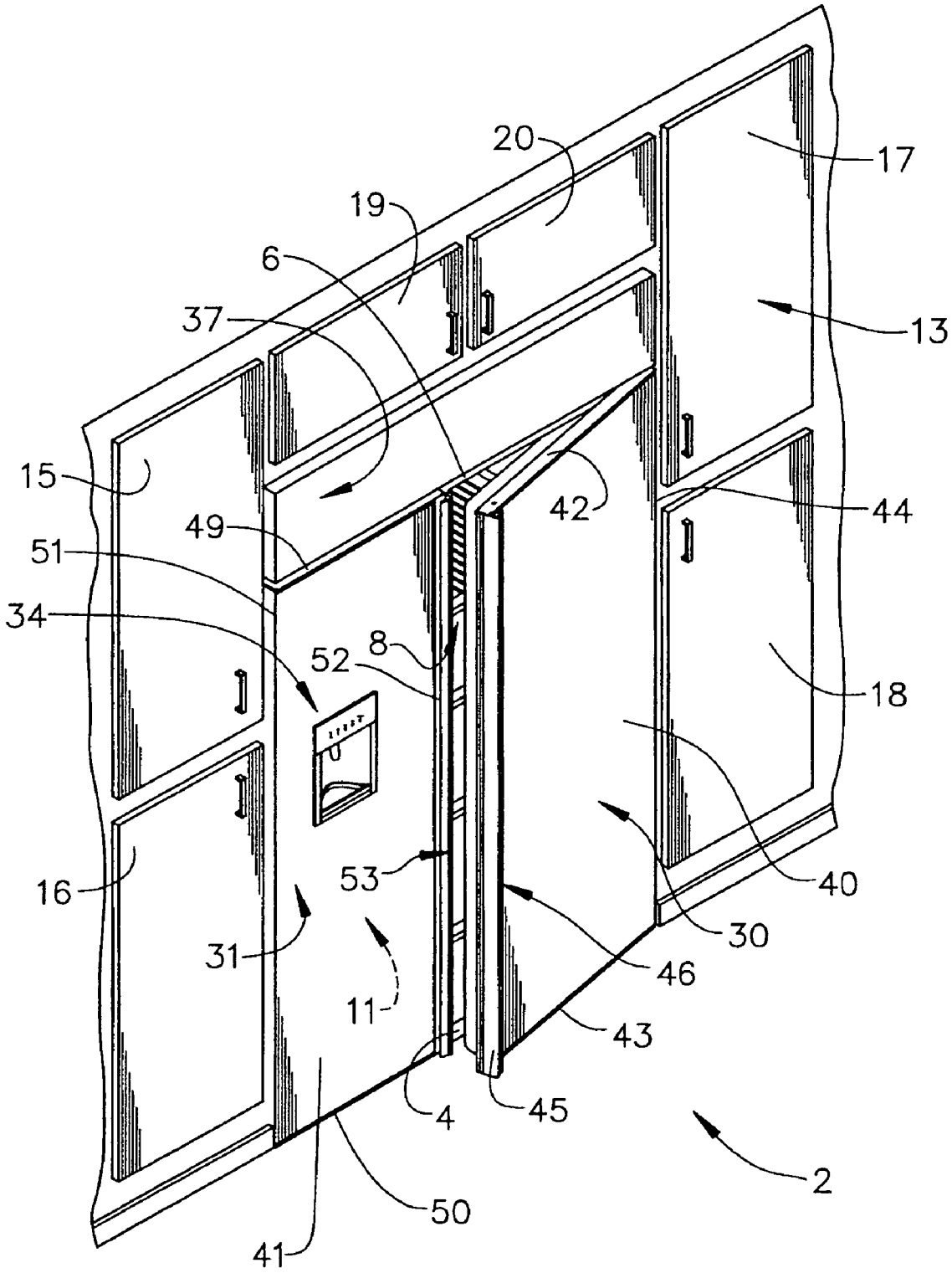
FIG. 1 is an upper left perspective view of a built-in side-by-side refrigerator incorporating a universal trim piece system constructed in accordance with the present invention.

With initial reference to FIG. 1, a refrigerator, generally indicated at 2, includes a cabinet 4 having a liner 6 that defines a fresh food compartment 8. Refrigerator 2 also includes another liner (not shown) that defines a freezer compartment 11. In the embodiment shown, refrigerator 2 constitutes a built-in model which is recessed into a wall adjacent cabinetry 13 that includes a plurality of cabinet doors 15-20. Refrigerator 2 includes a fresh food compartment door 30 pivotally mounted to cabinet 4, as well as a freezer compartment door 31 having arranged therein a dispenser 34. In addition to fresh food and freezer compartment doors 30 and 31, refrigerator 2 also includes an upper, mechanical compartment door 37 behind which are arranged various components of a refrigeration system (not shown). With this construction, refrigerator 2 constitutes a side-by-side model. However, it should be understood that the present invention can also be incorporated into other models, such as top mount, bottom mount and French-Door Style door units.

As shown, fresh food door 30 includes an outer decorative panel 40 that provides a finished appearance for refrigerator 2. Likewise, freezer door 31 is provided with a similar, outer decorative panel 41. Outer decorative panel 40 is held in place by top, bottom and opposing side trim pieces 42-45. In the embodiment shown in FIG. 1, side trim piece 45 defines a handle 46 for fresh food door 30. In a similar manner, outer decorative panel 41 is held in place through top, bottom and opposing side trim pieces 49-52, with side trim piece 52 defining a handle 53. At this point, it should be understood that each door 30, 31 is similarly constructed such that a detailed description will continue with reference to door 31 with an understanding that door 30 includes corresponding structure.

Figure 2:
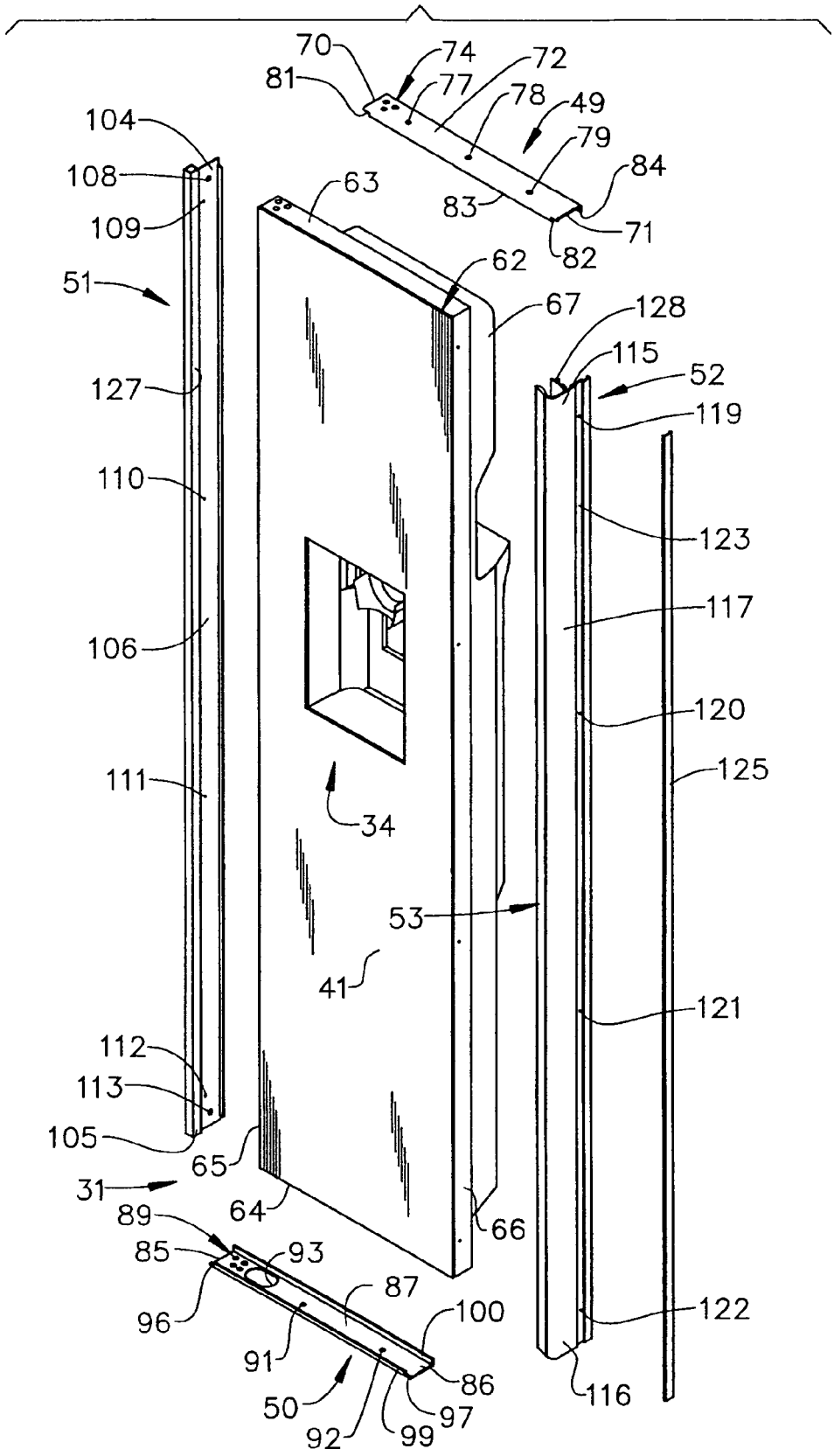
FIG. 2 is an exploded view of a freezer compartment door of the refrigerator of FIG. 1 configured with a side mounted handle and the universal trim piece system constructed in accordance with the present invention.

As best shown in FIG. 2, freezer door 30 includes a frame 62 including top, bottom and opposing side edge portions 63-66 that define a front face portion (not shown) to which is mounted outer decorative panel 41 and an inner face portion (not shown) to which is mounted an inner liner 67. As described above, outer decorative panel 41 is held in place by the plurality of trim pieces 49-52 which are secured to top, bottom and opposing side edge portions 63-66 respectively. As shown, top trim piece 49 includes a first end 70 that extends to a second end 71 through an intermediate portion 72. Arranged at first end 70 are a first plurality of openings 74 that are designed to receive a hinge assembly (not shown). Trim piece is held in place or secured to top edge portion 63 by a plurality of mechanical fasteners (not shown) that extend through a second plurality of openings 77-79 arranged along intermediate portion 72. In addition, trim piece 49 is shown to include first and second notches 81 and 82 arranged at first and second ends 70 and 71 respectively, as well as inner and outer lip portions 83 and 84 which, as will be described more fully below, extend between first and second end portions 70 and 71 and retain outer decorative panel 41 against frame 62.

In a similar fashion, bottom trim piece 50 includes a first end 85 that extends to a second end 86 through an intermediate portion 87. Bottom trim piece 50 also includes a first plurality of openings 89 arranged at first end 85, as well as a second plurality of openings 91-92 which extend through intermediate portion 87 and are designed to receive mechanical fasteners (not shown) that secure bottom trim piece 50 to bottom edge portion 64. In addition, bottom trim piece 50 includes an opening or passage 93 that enables a water conduit and electrical cables to pass into freezer door 30. Finally, in a manner also similar to that described above, bottom trim piece 50 includes first and second notches 96 and 97 that are arranged at first and second ends 85 and 86 respectively, as well as opposing lip portions 99 and 100 that extend between first and second ends 85 and 86.

Also shown in FIG. 2, side trim piece 51 includes a first end 104 that extends to a second end 105 through an intermediate portion 106. Intermediate portion 106 is provided with a plurality of openings 108-113 that are designed to receive mechanical fasteners (not shown) that secure side trim piece 51 to side edge portion 65. Similarly, side trim piece 52 includes a first end 115 that extends to a second end 116 through an intermediate portion 117. Intermediate portion 117 includes a plurality of openings 119-122 that likewise receive mechanical fasteners (not shown) to secure side trim piece 52 to side edge portion 66. As shown, openings 119-122 are formed in a recessed channel 123 that extend longitudinally, substantially an entire length of trim piece 52. With this construction, once trim piece 52 is secured to door 30, a decorative trim cover 125 is snap-fittingly secured over channel 123 to provide a more finished or seamless appearance. Finally, each side trim piece 51, 52 is shown to include a respective flange member 127, 128 which serves as structure that retains outer decorative panel 41.

Figure 3:
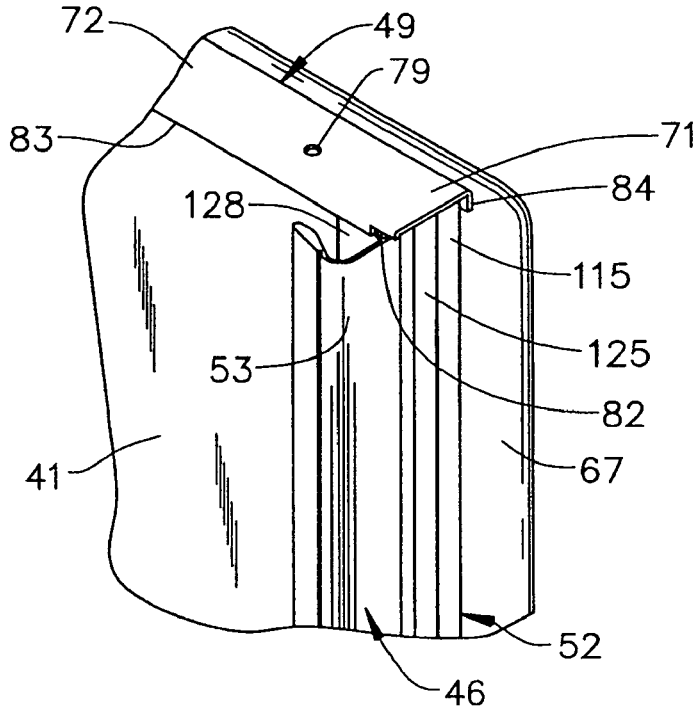
FIG. 3 is a partial view of the freezer compartment door of FIG. 2 illustrating the universal trim piece system mating with an upper portion of the side mounted handle.
Figure 5:
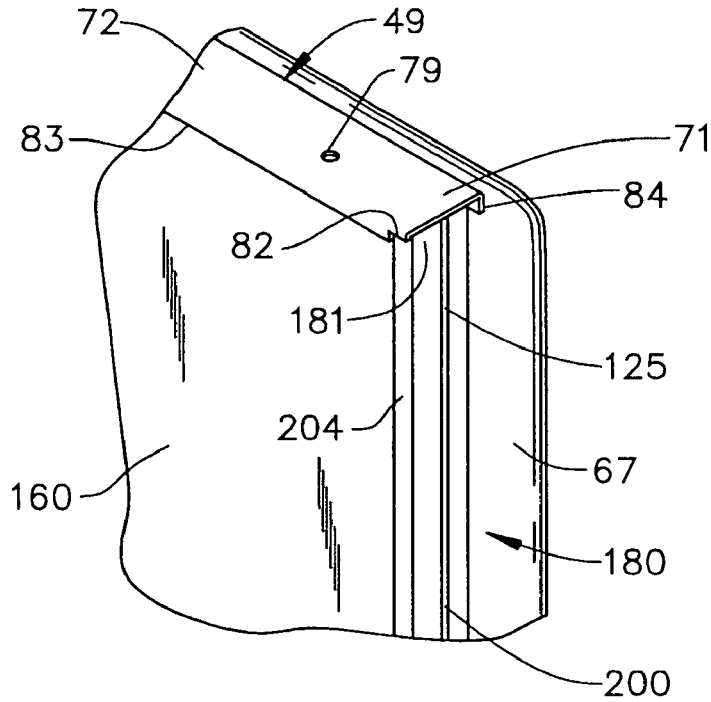
FIG. 5 is a partial view of the freezer compartment door of FIG. 4 illustrating the universal trim piece system mating with an upper portion of a side trim piece.
Figure 4:
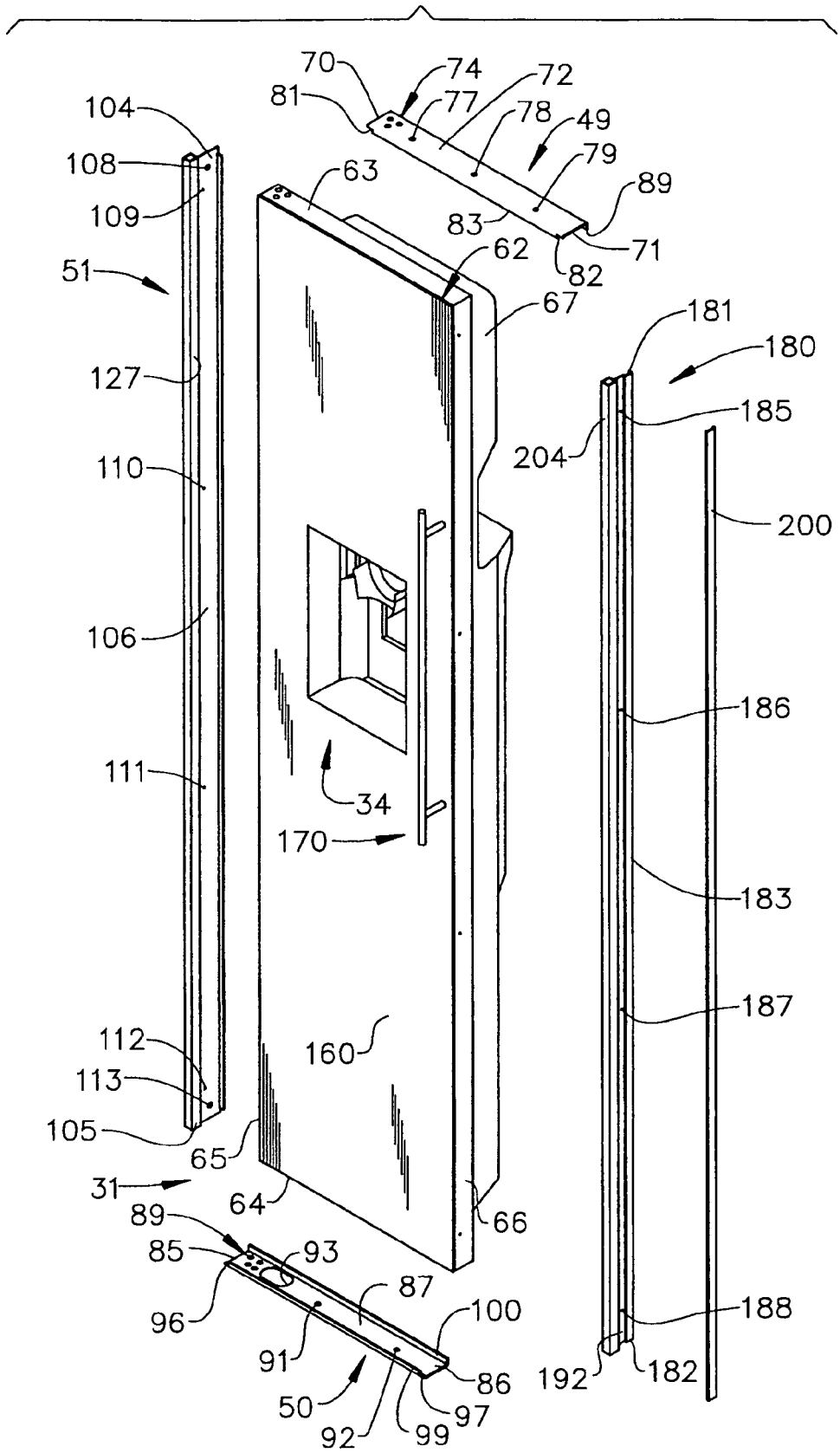
FIG. 4 is an exploded view of a freezer compartment door configured with a front mounted handle and the universal trim piece system constructed in accordance with the present invention.

In accordance with the invention, top and bottom trim pieces 49 and 50 are actually universal trim pieces that can be employed when door 30 is configured with a side-mounted handle as shown in FIGS. 2 and 3 or with a front-mounted handle as shown in FIG. 4. More specifically, FIGS. 4 and 5 illustrate door 30 configured with an outer decorative panel 160 made of wood, metal, plastic or the like and designed to blend in with adjacent cabinetry 13. In this configuration, handle 170 is secured to outer decorative panel 160, with handle 170 preferably matching cabinet pulls on cabinetry 13. In this configuration, side trim piece 52 is replaced with a side trim piece 180 which, as shown, more closely mimics side trim piece 51. More specifically, side trim piece 180 includes a first end 181 that extends to a second end 182 through an intermediate portion 183. In a manner and location directly corresponding to that described above with respect to side trim piece 52, side trim piece 180 includes a plurality of openings 185-188 that are formed within a channel 192. Upon securing side trim piece 180 to door 30 with mechanical fasteners (not shown), a trim cover 200 is snap-fittingly mounted in channel 192 to provide a more finished appearance for door 30. However, in contrast to that described above, instead of a handle, side trim piece 180 is provided with a flange 204 that serves as structure to help retain outer decorative panel 160.

As best shown in FIG. 3, when refrigerator 2 is configured with a side-mounted handle 46, universal trim piece 49 extends over side trim piece 52 with lip portions 83 and 84 overlapping outer decorative panel 41 and frame 62 so as to terminate flush with the majority of side trim piece 52 and trim cover 125. As further shown in FIG. 3, notch 82 is configured to receive an upper portion (not separately labeled) of handle 53, while notch 81 accommodates flange 127 (FIG. 2), in order to provide a more finished appearance for door 30. If, after having door 30 configured with a side mounted handle 46, a consumer wants to employ front mounted handle 170 that matches existing cabinet hardware and outer decorative panel 160, universal trim pieces 49 and 50 are simply loosened and slightly removed from door 30 thereby allowing decorative panel 41 to be exchanged or replaced with decorative panel 160 having attached thereto front mounted handle 170, as well as replacement of trim piece 52 with trim piece 180. At this point, universal trim piece 49 is re-secured to frame 62, with first end 71 extending over side trim piece 180 and notch 82 configured to cooperate with flange 204 to ensure a finished appearance for refrigerator 2. With this overall configuration, a consumer can easily choose to employ a side-mounted handle or a front-mounted handle configuration for refrigerator 2. However, unlike in the past where changing handle configurations or an overall appearance of doors 30 and 31 would be impossible or at least a costly procedure requiring complete door replacement, the present invention enables a consumer or a technician to readily replace outer decorative panels and handles to accommodate a consumer's particular needs without a costly service call or complete door reconstruction.

Although described with reference to a preferred embodiment of the invention, it should be readily understood that various changes and/or modifications can be made to the invention without departing from the spirit thereof. In general, the invention is only intended to be limited by the scope of the following claims.

We claim:

1. A method of assembling a refrigerator door including a door panel having top, bottom and opposing side edges that collectively define an inner surface and an outer surface comprising:

positioning a decorative panel on the outer surface of the door panel; and selectively fastening one of a front mounted handle to the decorative panel and a side mounted handle to one of the opposing side edges of the door panel wherein:

when employing the front mounted handle:

attaching the front mounted handle to the decorative panel; and attaching to the door panel a top trim piece, a bottom trim piece and first and second side trim pieces; and when employing the side mounted handle:

attaching to the door panel the top trim piece, the bottom trim piece and the first side trim piece; and attaching the side mounted handle along one of the opposing side edges in place of the second side trim piece.

2. The method of claim 1, further comprising, after employing the front mounted handle, replacing the front mounted handle with the side mounted handle while at least one of the top and bottom trim pieces remains supported by the door.

3. The method of claim 1, further comprising, after employing the side mounted handle, replacing the side mounted handle with the front mounted handle while at least one of the top and bottom trim pieces remains supported by the door.

4. The method of claim 1, further comprising:

when employing the side mounted handle, attaching a trim cover to the side mounted handle; and when employing the front mounted handle, attaching the trim cover to one of the opposing side trim pieces.

5. The method of claim 4, further comprising:

when employing the side mounted handle, snap-fittingly attaching the trim cover to the side mounted handle; and when employing the front mounted handle, snap-fittingly attaching the trim cover to the one of the opposing side trim pieces.

6. The method of claim 1, wherein the top trim piece includes a first end portion, a second end portion and an intermediate portion, said method further comprising extending each of said first and second end portions directly over respective ones of the first side trim piece and either the second side trim piece or the side mounted handle.

7. A method of replacing a door handle on a refrigerator having a door panel including top, bottom and opposing side edges that collectively define an inner surface and an outer surface, an inner liner secured to the inner surface and a decorative panel positioned on the outer surface of the door panel, said method comprising:

when switching from a front mounted handle to a side mounted handle:

loosening a top trim piece and a bottom trim piece that extend along the top and bottom edges respectively;

removing a side trim piece from one of the opposing side edges;

replacing the decorative panel having the front mounted handle with a decorative panel without a handle attached thereto;

attaching the side mounted handle to the one of the opposing side edges in place of the side trim piece; and re-securing the top and bottom trim pieces; and when switching from a side mounted handle to a front mounted handle:

loosening the top trim piece and the bottom trim piece;

removing the side mounted handle from one of the opposing side edges of the door panel;

replacing the decorative panel with a decorative panel having the front mounted handle, mounting a side trim piece to the one of the opposing side edges of the door panel; and re-securing the top and bottom trim pieces to the top and bottom edges respectively.

8. The method of claim 7, further comprising:

when employing the side mounted handle, attaching a trim cover to the side mounted handle; and when employing the front mounted handle, attaching the trim cover to one of the opposing side trim pieces.

9. The method of claim 8, further comprising:

when employing the side mounted handle, snap-fittingly attaching the trim cover to the side mounted handle; and when employing the front mounted handle, snap-fittingly attaching the trim cover to the one of the opposing side trim pieces.

10. The method of claim 7, wherein the top trim piece includes a first end portion, a second end portion and an intermediate portion, said method further comprising extending the second end portion of the top trim piece directly over either the side trim piece or the side mounted handle.

11. A method of assembling a refrigerator door including a door panel having top, bottom and opposing side edges that collectively define an inner surface and an outer surface, and an inner liner secured to the inner surface, and replacing a handle on the door, said method comprising:

positioning a decorative panel on the outer surface of the door panel; and selectively fastening one of a front mounted handle to the decorative panel and a side mounted handle to one of the opposing side edges of the door panel wherein:

when employing the front mounted handle:

attaching the front mounted handle to the decorative panel; and attaching to the door panel a top trim piece, a bottom trim piece and first and second side trim pieces; and when employing the side mounted handle:

attaching to the door panel the top trim piece, the bottom trim piece and the first side trim piece; and attaching the side mounted handle along one of the opposing side edges in place of the second side trim piece; and when switching from the front mounted handle to the side mounted handle:

loosening the top trim piece and the bottom trim piece that extend along the top and bottom edges respectively;

removing the second side trim piece from one of the opposing side edges;

replacing the decorative panel having the front mounted handle with a decorative panel without a handle attached thereto;

attaching the side mounted handle to the one of the opposing side edges in place of the second side trim piece; and re-securing the top and bottom trim pieces; and when switching from a side mounted handle end to a front mounted handle:

loosening the top trim piece and the bottom trim piece;

removing the side mounted handle from one of the opposing side edges of the door panel;

replacing the decorative panel with a decorative panel having the front mounted handle;

mounting the second side trim piece to the one of the opposing side edges of the door panel; and re-securing the top and bottom trim pieces to the top and bottom edges respectively.

* * * * *